US007189060B2

(12) United States Patent
Liang

(10) Patent No.: US 7,189,060 B2
(45) Date of Patent: Mar. 13, 2007

(54) COOLING SYSTEM INCLUDING MINI CHANNELS WITHIN A TURBINE BLADE OF A TURBINE ENGINE

(75) Inventor: George Liang, Palm City, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 63 days.

(21) Appl. No.: 11/031,794

(22) Filed: Jan. 7, 2005

(65) Prior Publication Data

US 2006/0153679 A1 Jul. 13, 2006

(51) Int. Cl.
*F01D 5/18* (2006.01)

(52) U.S. Cl. ..... 416/97 R; 415/115

(58) Field of Classification Search ..... 415/115; 416/96 R, 97 R

See application file for complete search history.

(56) References Cited

U.S. PATENT DOCUMENTS 3,807,892 A * 4/1974 Frei et al. ..... 415/116
4,753,575 A 6/1988 Levengood et al.
4,767,268 A 8/1988 Auxier et al.
5,626,462 A 5/1997 Jackson et al.
5,700,131 A 12/1997 Hall et al.
6,033,181 A * 3/2000 Endres et al. ..... 416/97 R
6,135,715 A 10/2000 Correia
6,213,714 B1 4/2001 Rhodes
6,220,817 B1 4/2001 Durgin et al.
6,254,346 B1 7/2001 Fukuno et al.
6,290,463 B1 9/2001 Fargher et al.
6,331,098 B1 12/2001 Lee
6,340,047 B1 1/2002 Frey
6,402,470 B1 6/2002 Kvasnak et al.
6,499,949 B2 12/2002 Schafrik et al.
6,616,407 B2 9/2003 Barrett
2006/0140762 A1* 6/2006 Pietraszkiewicz et al. ..... 416/97 R

FOREIGN PATENT DOCUMENTS

JP 2004-132218 A 4/2004

* cited by examiner

*Primary Examiner*—Edward K. Look
*Assistant Examiner*—Nathan Wiehe

(57) ABSTRACT

A turbine blade for a turbine engine having a cooling system formed from one or more cooling channels having a plurality of mini channels. The cooling system may include first ribs forming a first passageway of mini channels in which the cross-sectional area of the cooling channel is reduced, thereby increasing the velocity of the cooling fluids and the internal heat transfer coefficient. The cooling system may also include second ribs forming a second passageway downstream from the first passageway a distance sufficient to prevent the formation of a fully developed boundary layer and allow the cooling fluids to fully expand after exiting the first passageway. The cooling channel may also include a plurality of protrusions extending from surfaces forming the cooling channel to create turbulence and prevent formation of a fully developed boundary layer.

20 Claims, 5 Drawing Sheets

COOLING SYSTEM INCLUDING MINI CHANNELS WITHIN A TURBINE BLADE OF A TURBINE ENGINE

FIELD OF THE INVENTION

This invention is directed generally to turbine blades, and more particularly to the components of cooling systems located in hollow turbine blades.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures. In addition, turbine blades often contain cooling systems for prolonging the life of the blades and reducing the likelihood of failure as a result of excessive temperatures.

Typically, turbine blades, as shown in FIG. 1, are formed from a root portion at one end and an elongated portion forming a blade that extends outwardly from a platform coupled to the root portion at an opposite end of the turbine blade. The blade is ordinarily composed of a tip opposite the root section, a leading edge, and a trailing edge. The inner aspects of most turbine blades, as shown in FIG. 2, typically contain an intricate maze of cooling channels forming a cooling system. The cooling channels in the blades receive air from the compressor of the turbine engine and pass the air through the blade. The cooling channels often include multiple flow paths that are designed to maintain all aspects of the turbine blade at a relatively uniform temperature. However, centrifugal forces and air flow at boundary layers often prevent some areas of the turbine blade from being adequately cooled, which results in the formation of localized hot spots. Localized hot spots, depending on their location, can reduce the useful life of a turbine blade and can damage a turbine blade to an extent necessitating replacement of the blade.

Many conventional turbine blades have relatively thick outer walls, as shown in FIG. 3. It is understood in turbine blade design that the cooling efficiency of a turbine blade may be improved by reducing the cooling channel wall thickness. However, a reduction in cooling channel wall thickness causes an increase in the cross-sectional area of the cooling channel, which reduces the internal Mach number and the velocity of cooling fluids through the cooling system in the blade. The reduction in cooling fluid flow velocity causes the internal heat transfer coefficient to be reduced as well. Therefore, simply reducing the external wall thickness does not increase the efficiency of a cooling system. Thus, a need exists for a cooling system for a turbine blade that incorporates the advantages of a thin wall turbine blade while overcoming the reduced internal heat transfer coefficient and reduced internal Mach number associated with conventional cooling systems of thin wall cooling systems.

SUMMARY OF THE INVENTION

This invention relates to a turbine blade cooling system having a plurality of mini channels that reduce the cross-sectional area in thin wall turbine blade cooling systems and create numerous cooling system efficiencies. The turbine blade cooling system may be formed from at least one cooling channel having one or more first ribs positioned in the cooling channel extending from a first sidewall to a second sidewall generally opposite to the first sidewall forming at least two mini channels in a first passageway. The turbine blade may be formed from a generally elongated blade having a leading edge, a trailing edge, a tip at a first end, a root coupled to the blade at an end generally opposite the first end for supporting the blade and for coupling the blade to a disc, and at least one cooling channel forming the cooling system in the blade.

The cooling channel may also include one or more second ribs positioned in the cooling channel downstream from the first passageway and forming a second passageway. The second ribs may form two or more mini channels in the second passageway. The second ribs forming the second passageway may be positioned downstream from the first passageway a sufficient distance such that a ratio of a distance between the first and second passageways relative to the hydraulic diameter of the mini channel is about four or less. The first passageway be may also be greater in width than the second passageway, thereby reducing the cross-sectional area of the second passageway relative to the first passageway, which causes acceleration of the cooling fluids passing through the second passageway. Acceleration of the cooling fluids increase the efficiency of the cooling system in numerous ways.

The cooling channel may also include one or more protrusions protruding from a surface on the cooling system in a cooling channel. The protrusions may be aligned at an angle greater than zero relative to a longitudinal axis of the at least one cooling channel. The protrusions may also be aligned generally orthogonal to the longitudinal axis of the at least one cooling channel. In at least one embodiment, there exist a plurality of protrusions positioned throughout the cooling channel.

During operation, cooling fluids flow from the root of the blade into the turbine blade cooling system and more specifically, into the cooling channel. The cooling fluids, which may be, but are not limited to, air, enter the first passageway. As the cooling fluids enter the mini channels, the cooling fluids accelerate as the fluids pass into the mini channels formed by the first ribs because the first ribs restrict the cross-sectional area of the cooling channel. In at least one embodiment, the cross-sectional area may be reduced by about 50 percent. The increased velocity of the cooling fluids generates a very high rate of heat transfer. The cooling fluids exit from the mini channels in the first passageway before the fluid flow becomes fully developed. The cooling fluids expand in the area between the first and second passageways. In at least one embodiment, the cooling fluids may become fully expanded because the cross-sectional area of the cooling channel is about twice as large as a cross-sectional area of the first passage. The cooling fluids that exit the first passageway impinge onto the second ribs in the second passageway. The cooling fluids flow through the remainder of the cooling chamber and remove heat therefrom.

The configuration of the cooling channel increases the efficiency of the turbine blade cooling system in that expansion of the cooling fluids creates a highly turbulent cooling fluid flow between the first and second passageways. Additionally, the cooling fluids that accelerate as the fluids flow through the first and second passageways generate a high internal heat transfer coefficient.

An advantage of this invention is that the cooling system reduces the aspect ratio of the cooling channel by forming a series of mini channels and maintaining or increasing the through flow velocity and internal heat transfer coefficient.

Another advantage of this invention is that the cooling system creates a highly turbulent cooling flow between the first and second passageways.

Yet another advantage of this invention is that the ribs forming the first and second passageways increase the convection coefficients by increasing the velocity of the cooling fluid flow and are constructed with a length that prevents formation of a fully developed boundary layer.

Another advantage of this invention is that the second passageway is positioned a distance downstream of the first passageway such that the cooling fluids emitted from the first passageway impinge on the second ribs forming the second passageway and vice versa when the pattern is repeated downstream.

Still another advantage of this invention is that the ribs increase the convective surface area in the cooling system, thereby enhancing the overall cooling effectiveness of the cooling system.

Another advantage of this invention is that the ribs create additional cold metal for the airfoil mid-chord section, thereby lowering the mass average temperature for the turbine blade and increasing the turbine blade creep capability.

Yet another advantage of this invention is the continuous expansion and contraction of cooling fluids in the cooling system that creates a multiple entrance effect, which results in high levels of heat transfer for the entire serpentine flow channel.

Another advantage of this invention is that the cooling system enables the turbine blade to be formed from a thin outer wall, thereby improving the overall airfoil cooling performance without negatively affecting the velocity of cooling fluids through the cooling system.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
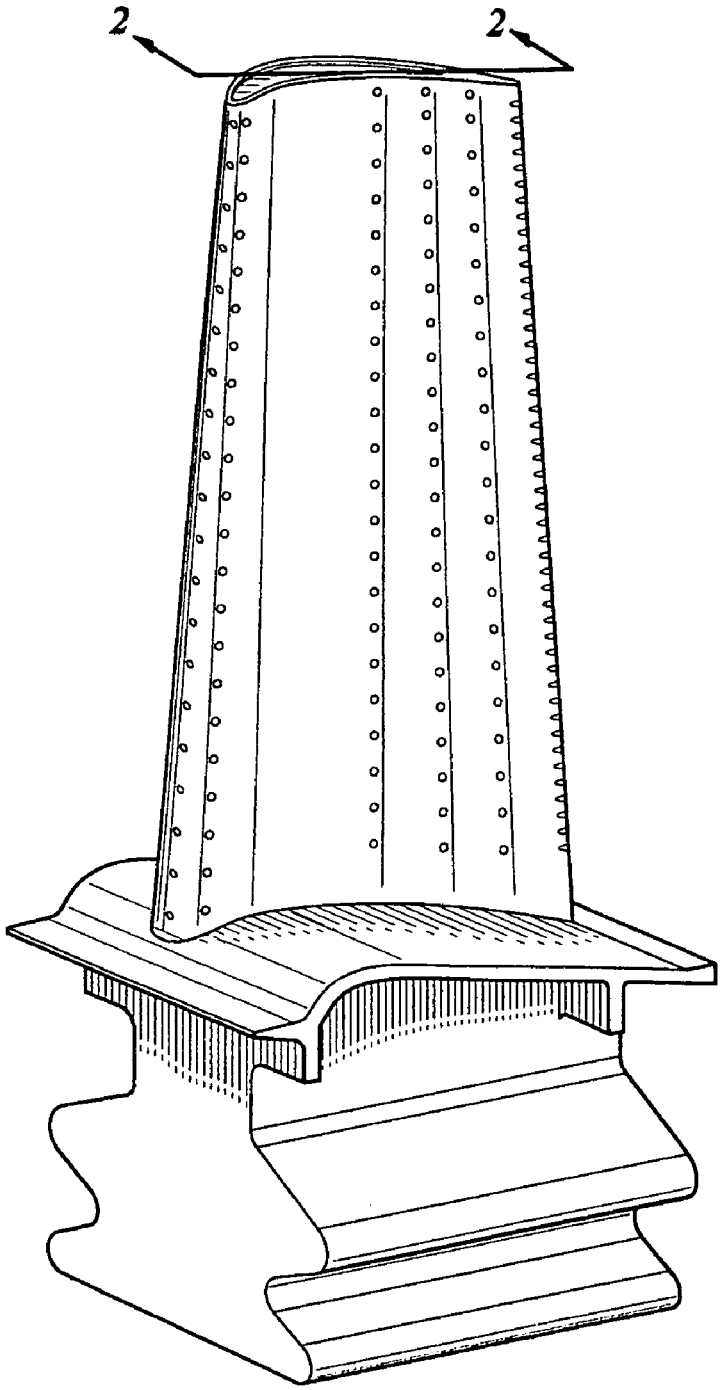
FIG. 1 (Prior Art)
FIG. 1 is a perspective view of a conventional turbine blade having features according to the instant invention.
Figure 2:
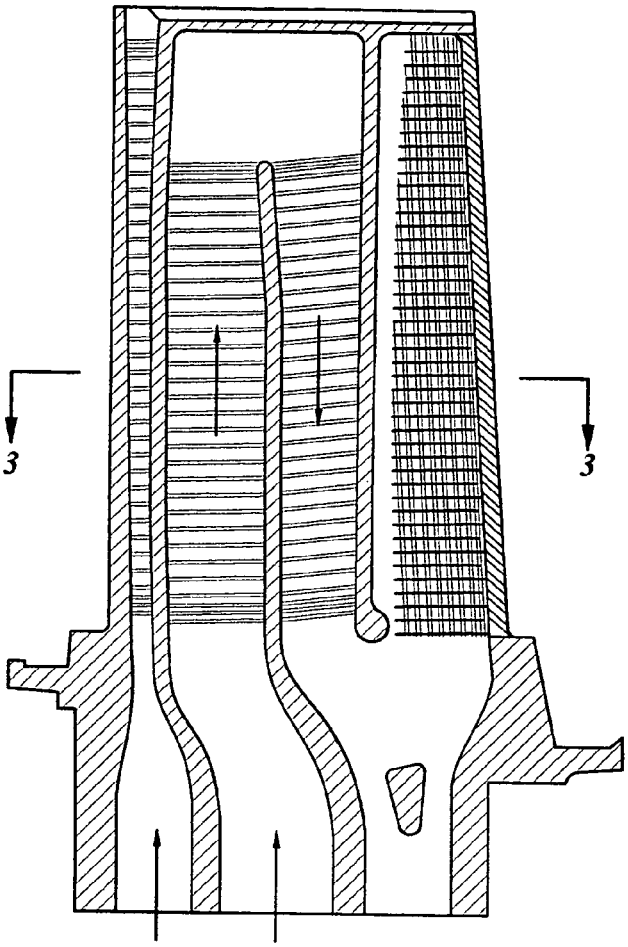
FIG. 2 (Prior Art)
FIG. 2 is cross-sectional view, referred to as a filleted view, of the conventional turbine blade shown in FIG. 1.
Figure 3:
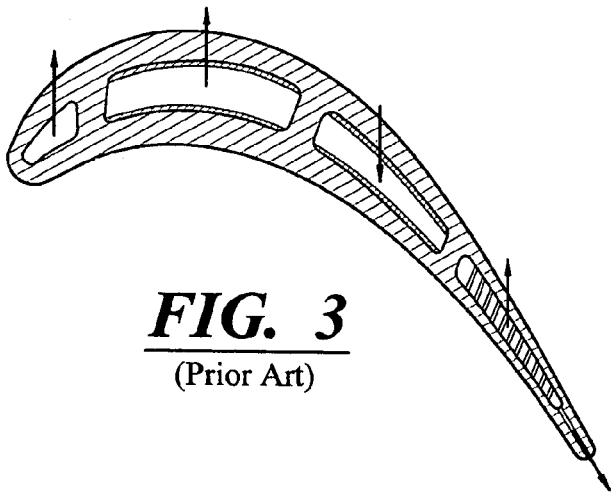
FIG. 3 (Prior Art)
FIG. 3 is a partial cross-sectional view of the conventional turbine blade shown in FIG. 2 taken along line 3—3.
Figure 4:
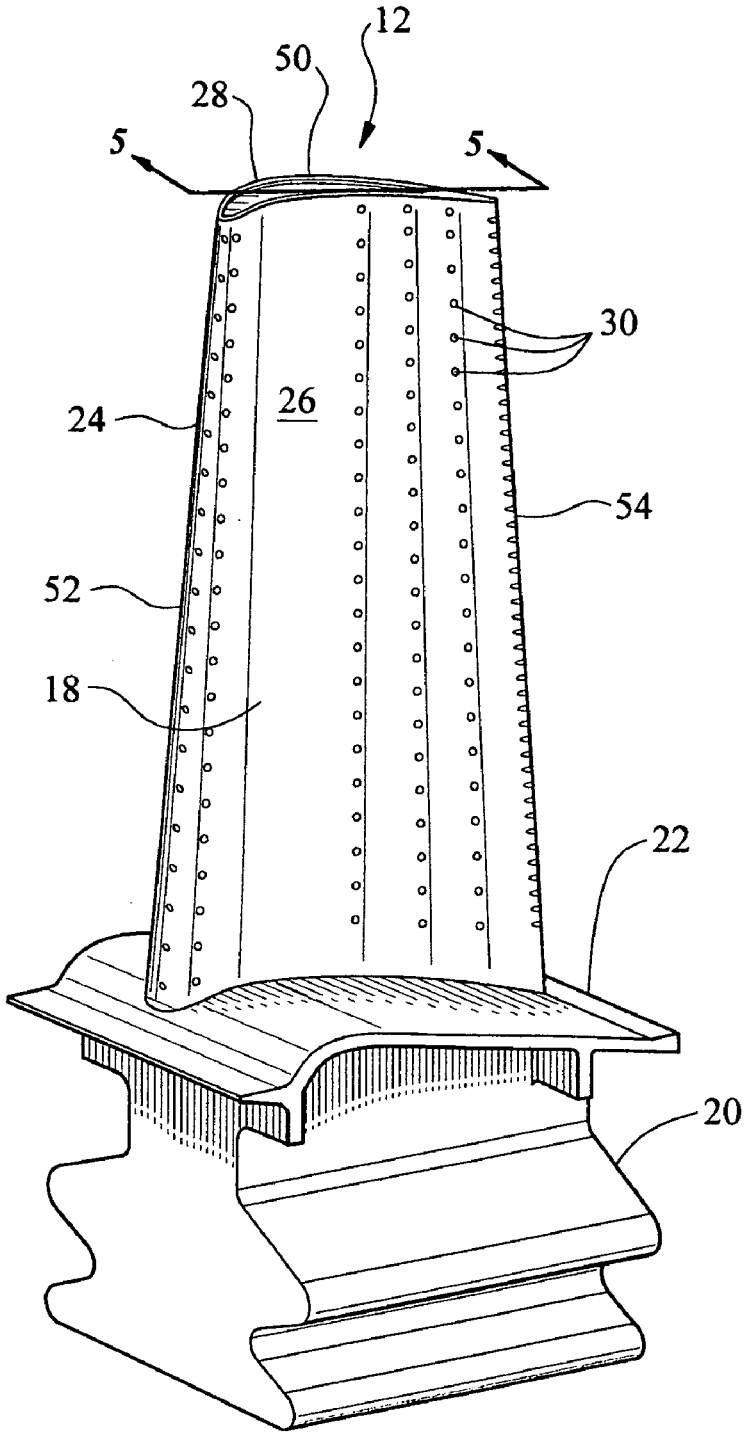
FIG. 4 is a perspective view of a turbine blade having features according to the instant invention.
Figure 5:
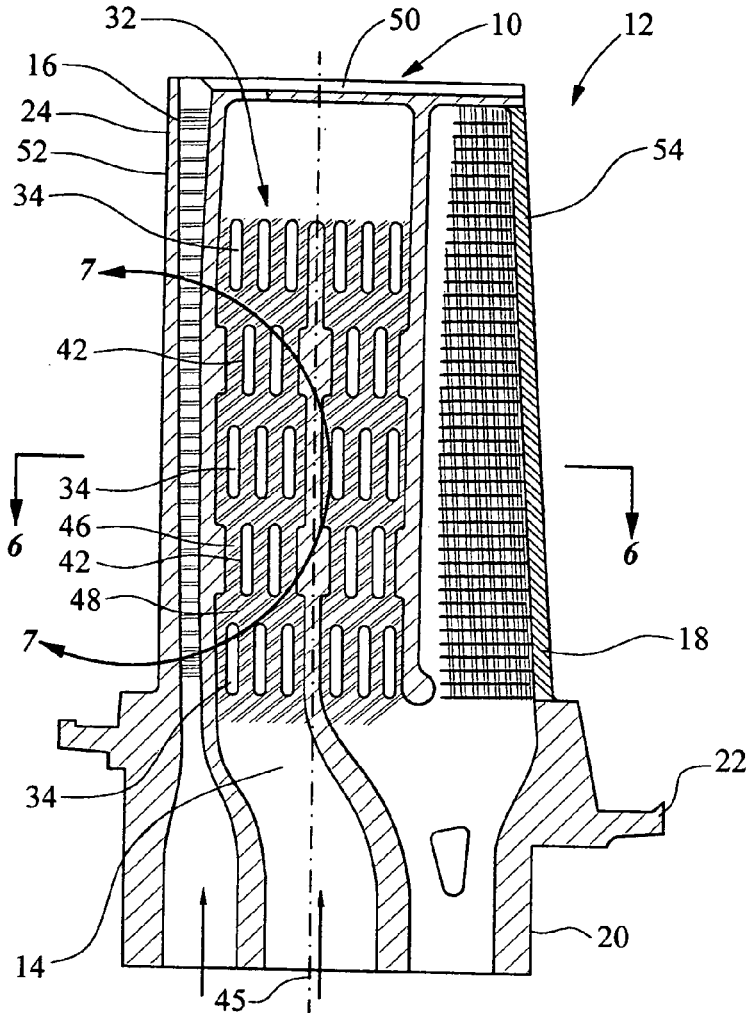
FIG. 5 is cross-sectional view, referred to as a filleted view, of the turbine blade shown in FIG. 4 taken along line 5—5.

As shown in FIGS. 4–8, this invention is directed to a turbine blade cooling system 10 for turbine blades 12 used in turbine engines. In particular, the turbine blade cooling system 10 is directed to a cooling system 10 formed at least from a cooling channel 14, as shown in FIG. 5, positioned between two or more walls forming a housing 16 of the turbine blade 12. As shown in FIG. 4, the turbine blade 12 may be formed from a generally elongated blade 18 coupled to the root 20 at the platform 22. Blade 18 may have an outer wall 24 adapted for use, for example, in a first stage of an axial flow turbine engine. Outer wall 24 may have a generally concave shaped portion forming pressure side 26 and a generally convex shaped portion forming suction side 28.

The channel 14, as shown in FIG. 5, may be positioned in inner aspects of the blade 20 for directing one or more gases, which may include air received from a compressor (not shown), through the blade 18 and out one or more orifices 30 in the blade 18 to reduce the temperature of the blade 18. As shown in FIG. 4, the orifices 30 may be positioned in a tip 50, a leading edge 52, or a trailing edge 54, or any combination thereof, and have various configurations. The channel 14 may be arranged in various configurations, and the cooling system 10 is not limited to a particular flow path.

Figure 6:
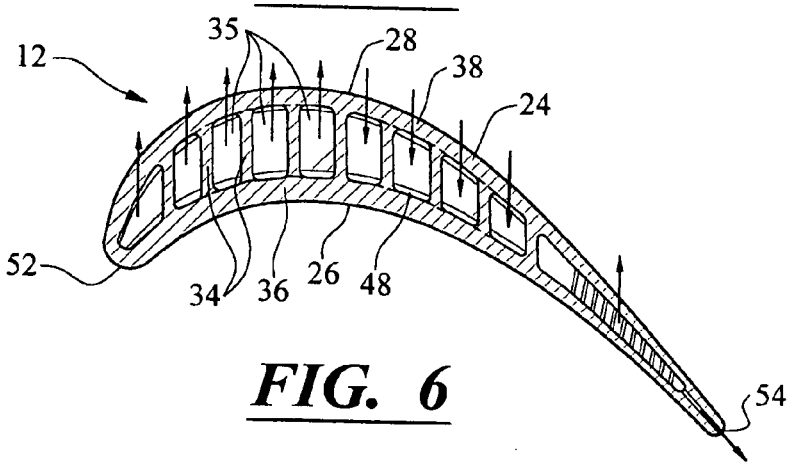
FIG. 6 is a partial cross-sectional view of the turbine blade shown in FIG. 5 taken along line 6—6.

The cooling system 10, as shown in FIG. 5, may be formed from one or more cooling channels 14 for directing cooling fluids through the turbine blade 12 to remove excess heat to prevent premature failure. The cooling channels 14 may include a series of ribs 32 extending into the channels 14 for increasing the efficiency of the cooling system 10. As shown in FIG. 5, the cooling channel 14 may include one or more first ribs 34 positioned in the cooling channel 14 at a first passageway 40. The first ribs 34 may be aligned with a longitudinal axis of the at least one cooling channel 14. As shown in FIG. 6, the first ribs 34 may extend from a first sidewall 36 to a second sidewall 38, which in at least one embodiment, are the pressure sidewall 26 and suction sidewall 28, respectively. The first ribs 34 may be positioned substantially parallel to each other, as shown in FIGS. 5 and 6. The first ribs 34 create mini channels 35 in the first passageway 40 through which the cooling fluids pass and create an abrupt entrance for the first passageway 40. The length (X) of the ribs 34 may be such that a ratio of the length of the ribs relative to a hydraulic diameter of the mini channels 35 is about 5.0 or less. The hydraulic diameter is defined as being four times the flow area of the mini channel divided by the total wet perimeter of the mini channel. In this case, the hydraulic diameter is equal to 4 times the width of the mini channel times the height of the mini channel divided by the total of two times the width plus two times the height. The ribs 34 in the cooling channel 14 cause the cooling fluids flowing through the cooling channel 14 to accelerate because of the reduced cross-sectional area of the cooling channel 14. The acceleration of the cooling fluids through the cooling system results in an increased convection rate.

Figure 7:
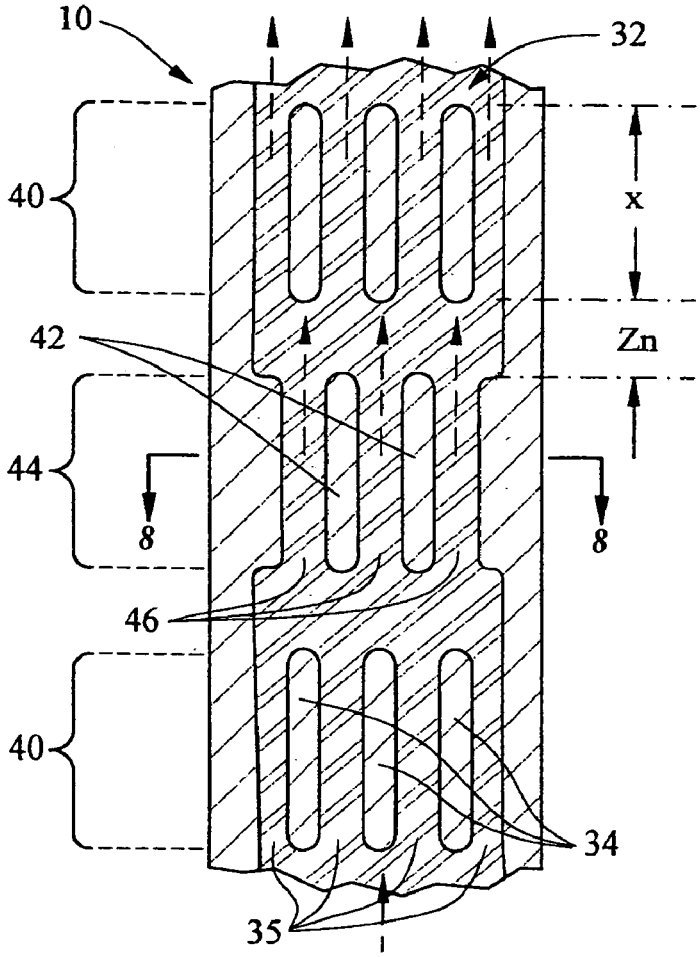
FIG. 7 is a detailed cross-sectional view of the turbine blade shown in FIG. 5 taken along line 7—7.

The cooling system 10 may also include one or more second ribs 42 extending from the first sidewall 36 to the second sidewall 38 and forming a second passageway 44. In at least one embodiment, the second passageway 44 may be sized such that the first passageway 40 may have a width that is greater than a width of the second passageway 44. The difference in widths between the first and second passageways 44 increases the efficiency of the cooling system. The second ribs 42 form mini channels 46 in the second passageway 44. In at least one embodiment, as shown in FIGS. 5 & 7, the second ribs 42 may be offset orthogonally relative to a longitudinal axis 45 of the turbine blade such that cooling fluids flowing from the first passageway 40 impinge on a leading edge of the second ribs 42. The second ribs 42 may be aligned with a longitudinal axis of the at least one cooling channel 14. As shown in FIGS. 5 & 7, the pattern of first passageways 40 positioned upstream of the second passageways 44 may be repeated throughout a cooling channel 14. The cooling channel 14 may have a serpentine shape or other configuration.

Figure 8:
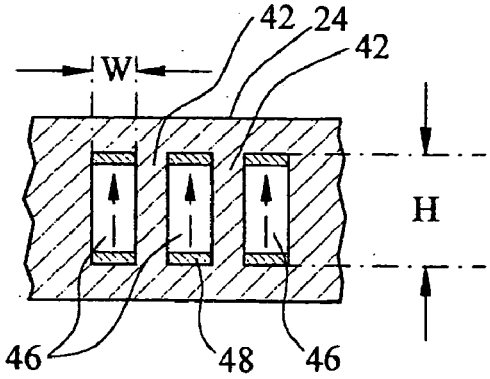
FIG. 8 is a cross-sectional view of the turbine blade shown in FIG. 7 taken along line 8—8.

In at least one embodiment, the second ribs 42 may be spaced from the first ribs 34 a distance (Zn) such that a ratio of the distance (Zn) between the ribs 34, 42 to a hydraulic diameter of the mini channels 35 is less than about 4.0. In addition, the mini channels 35, 46 may be sized such that an aspect ratio, as shown in FIG. 8, which is a ratio of the width (W) relative to the height (H) of a mini channel, is between about ¼ and about ½.

The cooling channel 14 may include one or more protrusions 48, which may also be referred to as trip strips or turbulators, extending from surfaces forming the chamber 14 for increasing the efficiency of the cooling system 10. The protrusions 48 prevent or greatly limit the formation of a fully developed boundary layer of cooling fluids proximate to the surfaces forming the cooling channel 14. The protrusions 48 may or may not be positioned generally parallel to each other and may or may not be positioned equidistant from each other throughout the cooling channel 14. The protrusions 48 may be aligned at an angle greater than zero relative to a general direction of cooling fluid flow through the cooling system 10. The protrusions 48 may also be aligned generally orthogonal to the flow of cooling fluids through the cooling channel. In at least one embodiment, there exist a plurality of protrusions 48 positioned throughout the cooling channel 14.

During operation, cooling fluids flow from the root 20 of the blade 12 into the turbine blade cooling system 10 and more specifically, into the cooling channel 14. The cooling fluids, which may be, but are not limited to, air, enter the first passageway 40. As the cooling fluids enter the mini channels 35, the cooling fluids accelerate as the fluids pass into the mini channel 35 formed by the first ribs 34 because the first ribs 34 restrict the cross-sectional area of the cooling channel 14. In at least one embodiment, the mini channel 35 may restrict the cross-sectional area of the cooling channel 14 by about 50 percent. The increased velocity of the cooling fluids generates a very high rate of heat transfer. The cooling fluids exit from the mini channels 35 in the first passageway 40 before the fluid flow becomes fully developed. As the cooling fluids exit the mini channel 35 the cooling fluids expand in the area between the first and second passageways 40, 44. In at least one embodiment, the cooling fluids may become fully expanded because the cross-sectional area of the cooling channel 14 is about twice as large as a cross-sectional area of the first passageway 40. The cooling fluids that exit the first passageway 40 impinge onto the second ribs 42 in the second passageway 44. The cooling fluids flow through the remainder of the cooling channel 14 and remove heat therefrom.

The configuration of the cooling channel 14 increases the efficiency of the turbine blade cooling system 10. For instance, expansion of the cooling fluids create a highly turbulent cooling fluid flow between the first and second passageways 40, 44 that increases the efficiency of the system. Additionally, the cooling fluids flowing through the first and second passageways 40, 44 generate a high internal heat transfer coefficient.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine blade, comprising:

a generally elongated blade having a leading edge, a trailing edge, a tip at a first end, a root coupled to the blade at an end generally opposite the first end for supporting the blade and for coupling the blade to a disc, and at least one cooling channel forming a cooling system in the blade;

at least one first rib in the at least one channel generally aligned with a longitudinal axis of the at least one cooling channel and extending from a first sidewall to a second sidewall generally opposite to the first sidewall forming a first passageway having at least two mini channels in the first passageway of the at least one cooling channel;

at least one second rib in the least one channel downstream from the first passageway, aligned with the longitudinal axis of the at least one cooling channel, and extending from the first sidewall to the second sidewall generally opposite to the first sidewall forming a second passageway having at least two mini channels in the second passageway; and at least one first protrusion protruding from a surface generally orthogonal to the at least one first rib and forming the at least one cooling channel.

2. The turbine blade of claim 1, wherein the at least one first protrusion comprises a plurality of protrusions protruding from a surface of the cooling system in a cooling channel and aligned at an angle greater than zero relative to the longitudinal axis of the at least one cooling channel.

3. The turbine blade of claim 1, wherein the at least one first rib comprises a plurality of first ribs positioned substantially parallel to each other.

4. The turbine blade of claim 3, wherein the at least one second rib comprises a plurality of second ribs positioned substantially parallel to each other.

5. The turbine blade of claim 4, wherein the plurality of second ribs are offset generally orthogonal to a longitudinal axis of the turbine blade relative to the first ribs forming the first passageway.

6. The turbine blade of claim 1, wherein a ratio of a distance between the at least one first rib and the at least one second rib to a hydraulic diameter of the at least one mini channel is less than about four.

7. The turbine blade of claim 1, wherein a width of the first passageway is greater than a width of the second passageway.

8. The turbine blade of claim 7, wherein the width of the first passageway is about 50 percent less than the width of the at least one cooling channel.

9. The turbine blade of claim 7, wherein the at least one cooling channel is formed a serpentine shaped channel comprising a plurality of first and second passageways positioned in alternating fashion along the serpentine shaped channel.

10. The turbine blade of the claim 1, wherein a ratio of a length of the at least one first rib to a hydraulic diameter of the at least one mini channel is less than about five.

11. The turbine blade of claim 1, wherein an aspect ratio of the mini channel is between about ½ and about ¼.

12. The turbine blade of claim 1, wherein the width of the first passageway is less than the width of the at least one cooling channel.

13. A turbine blade, comprising:

a generally elongated blade having a leading edge, a trailing edge, a tip at a first end, a root coupled to the blade at an end generally opposite the first end for supporting the blade and for coupling the blade to a disc, and at least one cooling channel forming a cooling system in the blade;

at least one first rib in the at least one channel generally aligned with a longitudinal axis of the at least one cooling channel and extending from a first sidewall to a second sidewall generally opposite to the first sidewall forming a first passageway having at least two mini channels in the first passageway of the at least one cooling channel;

at least one second rib in the least one channel downstream from the first passageway, aligned with the longitudinal axis of the at least one cooling channel, and extending from the first sidewall to the second sidewall generally opposite to the first sidewall forming a second passageway having at least two mini channels in the second passageway;

wherein a width of the first passageway is greater than a width of the second passageway; and at least one first protrusion protruding from a surface of the at least one cooling channel.

14. The turbine blade of claim 13, wherein the width of the first passageway is less than the width of the at least one cooling channel.

15. The turbine blade of claim 13, wherein the at least one cooling channel is formed a serpentine shaped channel comprising a plurality of first and second passageways positioned in alternating fashion along the serpentine shaped channel.

16. The turbine blade of claim 13, wherein the at least one first rib comprises a plurality of ribs positioned substantially parallel to each other and aligned with the flow of cooling fluids through the first passageway and wherein the at least one second rib comprises a plurality of ribs positioned substantially parallel to each other, offset orthogonally orthogonal to a longitudinal axis of the turbine blade and relative to the first ribs, and aligned with the longitudinal axis of the at least one cooling channel.

17. The turbine blade of claim 13, wherein a ratio of a distance between the at least one first rib and the at least one second rib to a hydraulic diameter of the at least one mini channel is less than about four.

18. The turbine blade of the claim 13, wherein a ratio of a length of the at least one first rib to a hydraulic diameter of the at least one mini channel is less than about five.

19. The turbine blade of claim 13, wherein an aspect ratio of the mini channel is between about ½ and about ¼.

20. A turbine blade, comprising:

a generally elongated blade having a leading edge, a trailing edge, a tip at a first end, a root coupled to the blade at an end generally opposite the first end for supporting the blade and for coupling the blade to a disc, and at least one cooling channel forming a cooling system in the blade;

a plurality of first ribs positioned generally parallel to each other in the at least one channel, generally aligned with a longitudinal axis of the at least one cooling channel, and extending from a first sidewall to a second sidewall generally opposite to the first sidewall forming a first passageway having at least three mini channels in the first passageway;

a plurality of second ribs positioned generally parallel to each other in the least one channel downstream from the first passageway, generally aligned with the longitudinal axis of the at least one cooling channel, offset orthogonally orthogonal to a longitudinal axis of the turbine blade and relative to the first ribs, and extending from the first sidewall to the second sidewall generally opposite to the first sidewall forming a second passageway having at least three mini channels in the second passageway;

wherein a width of the first passageway is less than a width of the at least one cooling channel;

wherein the at least one cooling channel forms a serpentine shaped channel comprising a plurality of first and second passageways positioned in alternating fashion along the serpentine shaped channel; and at least one first protrusion protruding from a surface of the cooling system in the at least one cooling channel.

* * * * *